US010758766B2

(12) United States Patent
Farias

(10) Patent No.: US 10,758,766 B2
(45) Date of Patent: Sep. 1, 2020

(54) STAGED-RESISTANCE TRAINING DEVICE AND METHOD OF USE

(71) Applicant: Joel Farias, Mesa, AZ (US)

(72) Inventor: Joel Farias, Mesa, AZ (US)

( * ) Notice: Subject to any disclaimer, the term of this patent is extended or adjusted under 35 U.S.C. 154(b) by 131 days.

(21) Appl. No.: 15/918,319

(22) Filed: Mar. 12, 2018

(65) Prior Publication Data

US 2018/0272173 A1 Sep. 27, 2018

Related U.S. Application Data

(63) Continuation-in-part of application No. 15/081,841, filed on Mar. 26, 2016, now abandoned.

(51) Int. Cl.

| | |
|---|---|
| ***A63B 21/062*** | (2006.01) |
| ***A63B 21/00*** | (2006.01) |
| ***A63B 1/00*** | (2006.01) |

(52) U.S. Cl.

CPC ..... *A63B 21/00076* (2013.01); *A63B 1/00* (2013.01); *A63B 21/00065* (2013.01); *A63B 21/00069* (2013.01)

(58) Field of Classification Search

CPC ..... A63B 21/00069; A63B 21/4027; A63B 21/0023; A63B 21/16; A63B 21/00076; A63B 21/063

See application file for complete search history.

(56) References Cited

U.S. PATENT DOCUMENTS

| | | | | |
|---|---|---|---|---|
| 3,458,188 | A * | 7/1969 | Infante | G09B 19/0015 472/133 |
| 3,751,031 | A | 8/1973 | Yamauchi | |
| 4,372,553 | A | 2/1983 | Hatfield | |
| 4,610,449 | A * | 9/1986 | Diercks, Jr. | A63B 21/0628 482/98 |
| 4,648,594 | A * | 3/1987 | Schleffendorf | A63B 21/0609 482/102 |
| 4,909,505 | A | 3/1990 | Tee | |
| 6,659,913 | B2 * | 12/2003 | Johnston | A63B 23/00 482/112 |
| D616,509 | S * | 5/2010 | Perez | D21/662 |
| 7,918,770 | B1 | 4/2011 | Hoole | |
| 8,192,334 | B2 * | 6/2012 | Sela | A63B 21/0628 482/98 |

(Continued)

*Primary Examiner* — Joshua T Kennedy

(74) *Attorney, Agent, or Firm* — Schmeiser, Olsen & Watts LLP

(57) ABSTRACT

A staged resistance training device is described. When performing an exercise motion, normal human joint mechanics often mean less effort is needed in the later stages of a resistance exercise motion than at the beginning of the motion. The staged resistance training device is configured to allow a user, such as a weightlifter using a training machine having a series of resistive elements, to perform an exercise repetition with staged resistance forces experienced during the repetition. A range of motion of the exercised body part is opposed during a first stage of the motion by an initial resistance, transitioning to a second, greater resistance in a later second stage of the exercise motion. The staged resistance training device provides a means wherein the user can apply increased resistance to overcome an increasing mechanical advantage later during an exercise motion, versus at the motion's beginning.

6 Claims, 5 Drawing Sheets

(56) References Cited

U.S. PATENT DOCUMENTS

| | | | | |
|---|---|---|---|---|
| 9,233,270 | B2 | 1/2016 | Luis Jacobo | |
| 9,656,115 | B2 | 5/2017 | Young | |
| 2002/0137608 | A1 | 9/2002 | Knight | |
| 2004/0009854 | A1* | 1/2004 | Shiang | A63B 21/0609 482/93 |
| 2012/0108403 | A1 | 5/2012 | Zandman-Zeman | |
| 2014/0200499 | A1* | 7/2014 | Champion | A63B 21/151 602/36 |
| 2014/0256519 | A1 | 9/2014 | Nelson | |
| 2014/0274593 | A1 | 9/2014 | Kelly | |
| 2016/0101309 | A1 | 4/2016 | Schreiber et al. | |
| 2017/0333742 | A1* | 11/2017 | Reese | A63B 21/00061 |

* cited by examiner

STAGED-RESISTANCE TRAINING DEVICE AND METHOD OF USE

CROSS REFERENCE TO RELATED APPLICATION

This application claims priority to U.S. Nonprovisional patent application to Joel Farias entitled "RESISTANCE STRAP," Ser. No. 15/081,841, filed Mar. 26, 2016, the disclosures of which are hereby incorporated entirely herein by reference.

BACKGROUND OF THE INVENTION

Technical Field

The present invention relates generally to resistance machine training aids; specifically, to devices providing staged resistance and methods of use.

State of the Art

It is well established that resistance training provides many health benefits. For example, regularly training at least two to three times per week using free weights, weight machines, or any other of a variety of currently available resistance training aids improves muscle strength and tone, protects against age-related muscle loss, maintains flexibility and balance, aids in weight management by increasing basal metabolism, reduces age-related cognitive decline, increases stamina, increases bone mineral density thereby reducing the risk of fracture, improves sleep, increases self-esteem, and generally enhances performance of everyday tasks.

One seeking to perform resistance training has many available choices of resistance training devices. Among the most popular of these devices are weight machines. Weight machines are available for use at virtually every gym and health club and may utilize stacks of weights from which the user selects a resistance level by inserting a retaining pin in-between weights on the stack, wherein weights above the pin are lifted and create a resistance force during the motion equal to the amount of weight selected. Machines offer many advantages over the use of free weights, such as barbells or dumbbells, including ease of operation, safety, minimal requirements for balance or coordination, and isolation of specific muscles or muscle groups.

Despite these advantages, however, resistance training machines use a fixed level of resistance during any single exercise. For example, a weight machine user positions a retaining pin between two weights of a weight stack, wherein the resistance across a user's range of motion during the exercise is fixed by the selected amount of weight being lifted by the motion. Although the weight is fixed, joint mechanics create a mechanical advantage which changes dynamically throughout the range of motion flexing or extending a joint during exercise. This dynamic mechanical advantage decreases the actual effort needed to complete a resistance exercise movement. Consequently, the resistance experienced by the exercising muscle(s) may be relatively high during a first-stage part of the motion transitioning to a much lower level during a second-stage part of the motion, diminishing the strength-building effectiveness of the exercise.

Currently available resistance training devices, including weight machines, are not capable of transitioning the amount of weight in the weight stack opposing an exercise motion, at a point during the motion, to overcome the increased mechanical advantage inherent in normal human joint mechanics.

Accordingly, a staged-resistance device and methods of use is needed.

DISCLOSURE OF THE INVENTION

The present invention relates generally to resistance machine training aids; specifically, to devices providing staged resistance and methods of use.

Disclosed is a staged-resistance training device comprising a flexible member having a first end, a second end, and a first length; a length adjuster coupled to the first end and adjustably coupled to the second end; a first retainer operatively coupled to the flexible member; and a second retainer operatively coupled to the flexible member, wherein movement of the length adjuster changes a second length along the flexible member between the first retainer and the second retainer.

In some embodiments, the first retainer is operatively coupled to the flexible member by a first coupling device. In some embodiments, the second retainer is operatively coupled to the flexible member by a second coupling device. In some embodiments, the first retainer is interchangeable on the flexible member with a selection of first retainers. In some embodiments, the second retainer is interchangeable on the flexible member with a selection of second retainers.

In some embodiments, the length adjuster is adjustable along a continuum. In some embodiments, the length adjuster is adjustable in increments.

In some embodiments, the device further comprises a plurality of flexible members having a plurality of first lengths, each of the plurality of flexible members interchangeable with the length adjuster, the first retainer, and the second retainer.

Disclosed is staged-resistance training device comprising a first retainer removably coupled to a first resistance, wherein the first resistance is configured to oppose a first stage of a range of motion, the range of motion comprising the first stage, a second stage, and a transition point, wherein the first stage precedes the second stage at the transition point; a second retainer removably coupled to a second resistance, wherein the second resistance is configured to oppose the second stage; and a resistance interval adjustment coupled between the first retainer and the second retainer, wherein the transition point is adjustable in response to movement of the resistance interval adjustment.

Disclosed is a method of using a \staged-resistance training device, comprising the steps of coupling a first resistance to a first retaining device on a flexible member; coupling a second resistance to a second retaining device on the flexible member; setting a length along the flexible member between the first retaining device and the second retaining device; moving a body part through a first stage of a range of motion against the first resistance to a transition point; and moving the body part through a second stage of the range of motion against the second resistance from the transition point.

The foregoing and other features and advantages of the present invention will be apparent to those of ordinary skill in the art from the following more particular description of the invention and its embodiments, and as illustrated in the accompanying drawing figures.

DETAILED DESCRIPTION OF EMBODIMENTS OF THE INVENTION

Figure 1:
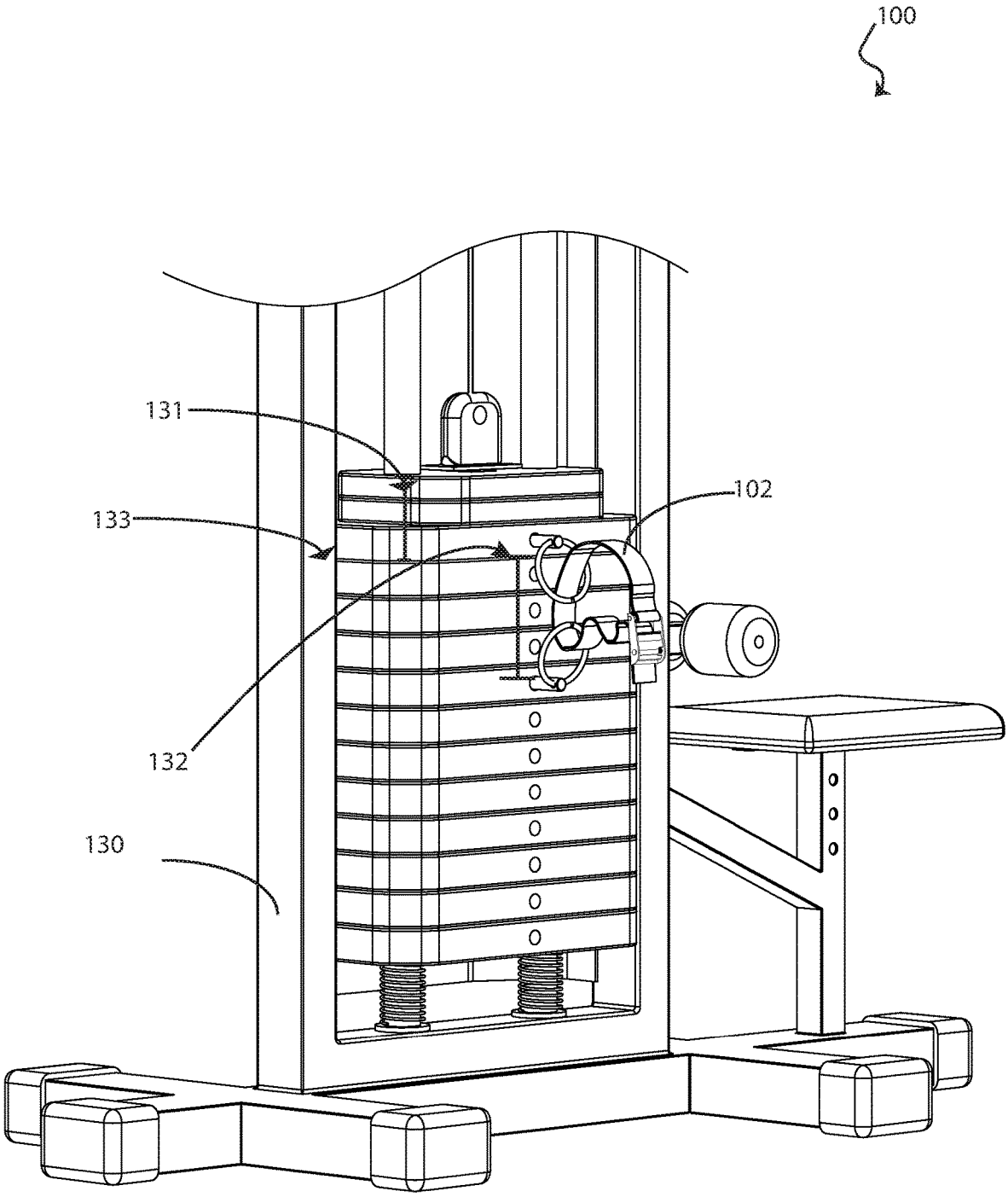
FIG. 1 is a perspective view of a staged resistance training device coupled to a resistance training machine.

As discussed above, this disclosure relates to resistance machine training aids; specifically, to devices providing staged resistance and methods of use.

Weight machines offer resistance training which is safe and easy to use. Regardless, currently available weight machines do not have options for changing the amount of weight lifted during a range of motion within any single repetition of an exercise movement. This disclosure provides devices and methods of use to transition the resistance, provided by a weight stack, within the range of motion comprising a repetition For the purposes of this disclosure a "repetition" or "rep" means a single full-cycle exercise movement which is typically repeated multiple times during an exercise. For example, a user may lie supine on an exercise machine, grasping a handle coupled to a portion of the machine's weight stack in each hand, exerting a lifting force against the handles to lift a selected portion of the machine's weight stack while flexing the shoulders and extending the elbows, then reversing this motion to lower the selected portion of the weight stack back onto the remaining unselected stack, completing one repetition or rep. A plurality of the same repetition performed one-after-the-other comprises a "set."

"Range of motion" means the scope or extent of motion physically executed in space by a body part, or combination of body parts, during a first half of a repetition. For example, it will be appreciated that, following the first half of a repetition against a resistance, such as raising weights from a weight stack, the range of motion is reverses to lower the weights back to rest on the weight stack. The range of motion is repeated with each repetition of a set of repetitions. For purposes of this disclosure, the range of motion is sometimes divided into subparts or "stages" which are consecutive. For example, the range of motion may consist of a first stage, a transition point, and a second stage, wherein the second stage immediately follows, but does not overlap, the first stage.

"Transition point" means the instantaneous point in time when the first stage of the range of motion ends and the second stage of the range of motion begins. In some embodiments of the disclosed invention, the range of motion is comprised—in sequential order—of a first stage, a transition point, and a second stage.

"Resistance interval adjustment" means changing or adjusting the relationship between the first stage, the transition point, and the second stage of the range of motion. For example, wherein the transition point is moved closer to the beginning of the range of motion, the first stage becomes proportionately shorter and the second stage becomes proportionately longer. Wherein the transition point is moved closer to the end of the range of motion, the first stage becomes proportionately longer and the second stage becomes proportionately shorter.

"Staged resistance" means a force opposing a range of motion having more than one magnitude, wherein a force of a first magnitude opposes one portion or "stage" of the range of motion and a force of a second magnitude opposes a second portion or stage of the range of motion.

FIG. 1 is a is a perspective view of a staged resistance training device coupled to a resistance training machine. FIG. 1 shows a staged resistance training device 100 having a flexible member 102 configured for coupling to a group of resistance elements 133 of a resistance training machine 130. Resistance elements 133, in some embodiments, are a "stack" comprising a plurality of weight plates. Although resistance elements 133 are shown as a weight stack in the several drawing figures, this is not meant to be limiting. Resistance elements 133 may comprise hydraulic resistance cylinders, springs including coil springs, bar springs, rod springs, and the like, in some embodiments. Resistance elements 133 comprises a first resistance body 131 and a second resistance body 132.

Device 100 is configured for coupling to resistance elements 133 at greater than one position, wherein an exercise motion by the user is initially opposed by a first resistance comprising a first resistance body 131, followed later in the exercise motion by a second resistance comprising first resistance body 131 combined with a second resistance body 132. In this manner, a user of device 100 experiences a resistance to the exercise motion which changes at a point during the motion according to how device 100 is coupled to resistance elements 133.

Figure 2:
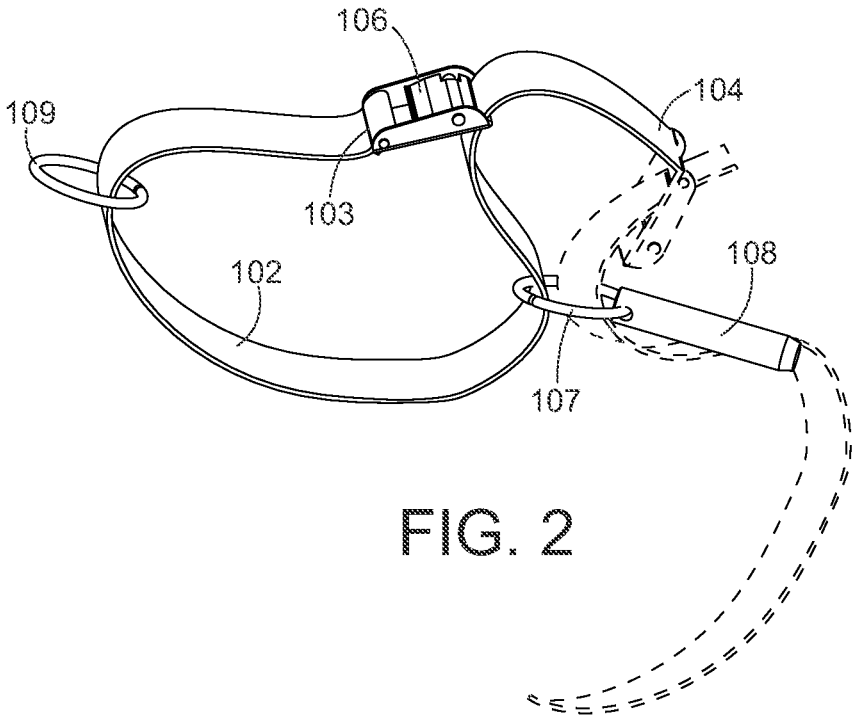
FIG. 2 is a perspective view of a staged resistance training device.

FIG. 2 is a perspective view of a resistance training device. FIG. 2 shows a staged resistance training device 100, including a flexible member 102 having a first end 103 and a second end 104. In some embodiments, a length adjuster 106 is operatively coupled to first end 103, as shown by FIG. 2. Device 100 additionally comprises a first retainer 108 and a second retainer 110 operatively coupled to flexible member 102. In some embodiments, length adjustor 106 adjusts a length between retaining elements which functionally couple device 100 to resistance training machine 130. The length between the retaining elements determines at which point within the exercise movement that the first resistance transitions to the second resistance. Depending upon the exercise being performed, the anthropometric characteristics of the user—such as arm length, height, torso length, etc.—and the type of resistance training machine 130 used, many lengths between the retaining elements may be used. The use of device 100, including adjustment of the length between first retainer 108 and a second retainer 110, is discussed in detail herein below.

A first retainer 108 and second retainer 110 are elements to couple device 100 to resistance training machine 130. The actual structure of first retainer 108 and second retainer 110 depend upon the nature of the resistance elements 133 installed on resistance training machine 130. For example, in the drawing figures, including FIG. 2, first retainer 108 is a pin-like structure which is interposed within openings on a weight stack. The weights, or other resistance elements 133, above first retainer 108 form first resistance body 131. At some interval below first resistance body 131, second retainer 110 is also coupled to resistance elements 133 of training machine 130 to add a resistance created by second resistance body 132 to that of first resistance body 131.

FIG. 2 also shows a first coupling device 107 operatively coupling first retainer 108 to flexible member and a second coupling device 109 operatively coupling second retainer 110 to flexible member 102. The nature and form of first coupling device 107 and second coupling device 109 are dependent upon the form of flexible member 102. In the non-limiting example shown in FIG. 2, and the other drawing figures, first coupling device 107 is a ring-shaped body which slides along flexible member 102. This is not meant to be limiting. First coupling device 107, in some embodiments, is s D-ring, a flat or tubular sleeve, or the like, wherein first coupling device operatively couples first retainer 108 to flexible member 102. In a prototype of the invention, and in some other embodiments, first coupling device 107 is an automobile seatbelt buckle. In some embodiments, first coupling device 107 moves freely along flexible member 102, according to dynamic forces acting upon staged resistance training device 100 during performance of an exercise motion by a user. In some embodiments (not shown), however, training device 100 is configured wherein first coupling device 107 is fixedly coupled to flexible member 102.

Similarly, second coupling device 109, in some embodiments, is operatively coupled to flexible member 102 and, in other embodiments, fixedly coupled. In some embodiments, one of either first coupling device 107 or second coupling device 109 is operatively coupled to flexible member 102 and the other of either first coupling device 107 or second coupling device 109 is fixedly coupled to flexible member 102.

In FIG. 2, and several of the other drawing figures, first coupling device 107 and second coupling device 109 are both operatively coupled to flexible member 102. This allows the user of staged resistance training device 100 to 1) select the desired first resistance body 131 and engage first retainer 108 with resistance elements 133 in the proper position for first resistance body 131 to create a first resistance 112; 2) select the desired second resistance body 132; and 3) adjust the distance between first coupling device 107 and second coupling device 109 at which second resistance body 132 becomes taut and engaged to create second resistance 113, using length adjuster 106.

First coupling device 107 is coupled to first retainer 108 and second coupling device 109 is coupled to second retainer 110. When staged resistance training device 100 is assembled, flexible member 102 passes through both first coupling device 107 and second coupling device 109. As discussed herein, first coupling device 107 and second coupling device 109 may slide or otherwise pass freely along the length of flexible member 102. In some embodiments (not shown), first coupling device 107 and first retainer 108 comprise a unitary body; in other embodiments, including the embodiment shown in FIG. 3, these elements are separable. Similarly, in some embodiments, second coupling device 109 and second retainer 110 comprise a second unitary body. The exact configuration of first retainer 108 and second retainer 110 are, necessarily, dependent upon the design and configuration of resistance training machine 130 and resistance elements 133, as mentioned herein.

In some embodiments, as shown in FIG. 2 in broken lines, staged resistance training device comprises a plurality of flexible members 102 coupled to a corresponding plurality of first coupling devices 107 and second coupling devices 109. For example, providing a plurality of flexible member-coupling device combination provides the user with options to create a "chain" of flexible members 102 coupled to a series of resistive elements. In this way, a user can create greater than two stages; such as a first stage, a second stage, a third stage, a fourth stage, etc.; wherein each stage of an exercised body part's range of motion is opposed by a resistive force of sequentially increasing magnitude.

Figure 3:
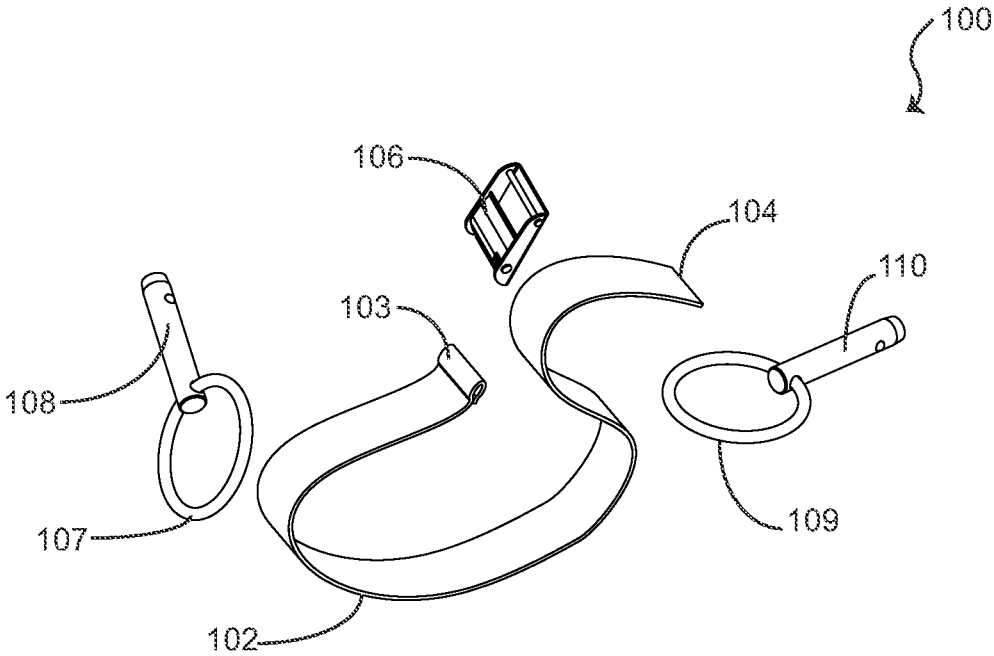
FIG. 3 is an exploded perspective view of a staged resistance training device.

FIG. 3 is an exploded perspective view of a resistance training device. FIG. 3 shows device 100, including flexible member 102 with first end 103 and second end 104, length adjuster 106, first coupling device 107, first retainer 108, second coupling device 109, and second retainer 110. Training device 100 is designed to collapse for easy portability, therefore an elongate woven cloth member, such as a length of nylon webbing, for example, is used to form flexible member 102, in some embodiments. This is not meant to be limiting; any woven synthetic or natural material which is suitably strong to safely bear forces created by first resistance body 131 and second resistance body 132 of resistive elements 133. Additionally, as suggested by FIGS. 2-3, second end 104 may be uncoupled from length adjuster 106 to facilitate removal of first coupling device 107 and second coupling device 109 from flexible member 102, allowing the user of device 100 to exchange first retainer 108, second retainer 110, or both first retainer 108 and second retainer 110 with retainers from a selection of first retainers 108 or second retainers 110 having other forms, shapes, and dimensions configured to removably couple with any of a range of corresponding forms of resistive elements 133.

Figure 4:
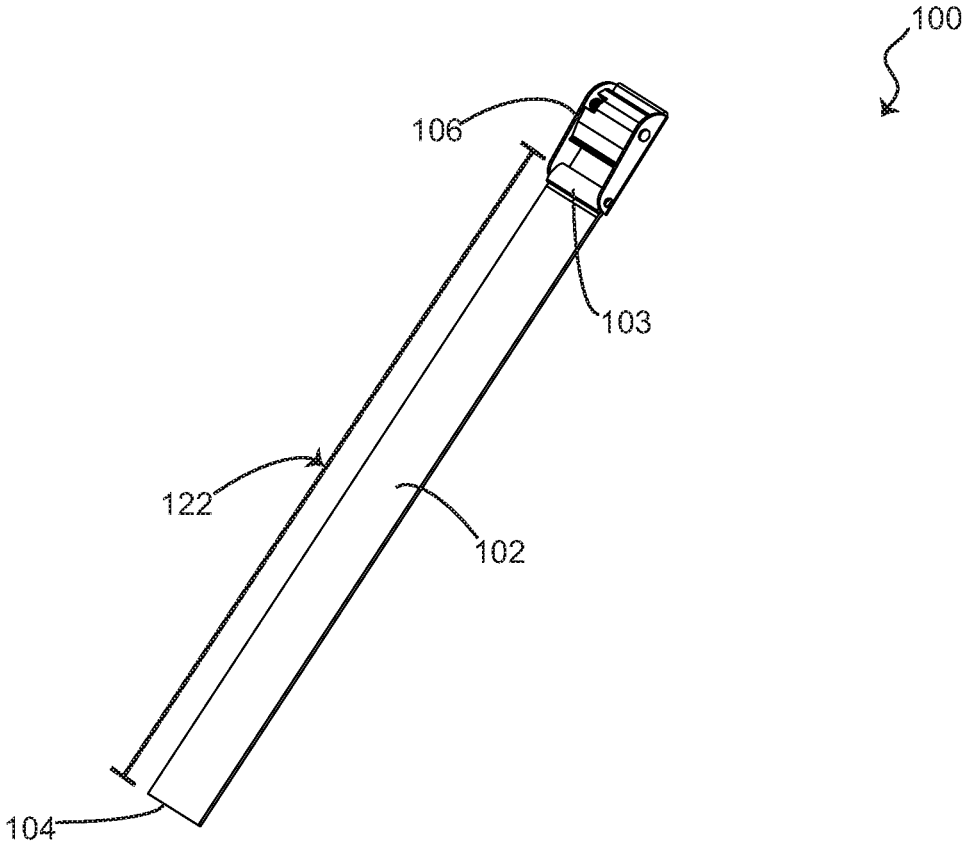
FIG. 4 is a perspective view of a flexible member coupled to a length adjusting device.

FIG. 4 is a perspective view of a flexible member coupled to a length adjusting device. FIG. 4 shows length adjustor 106 coupled to first end 103 of flexible member 102. The length of flexible member 102 forms a first length 123, which is the distance from a point whereupon length adjustor 106 couples to flexible member 102.

In some embodiments, first length 122 is about twenty inches. In some embodiments, first length 122 is about twenty-four (24) inches. In some embodiments, first length 122 is about thirty-six (36) inches. In some embodiments, first length 122 is between about twenty-two (22) and about twenty-eight (28) inches. In some embodiments, first length 122 is greater than about thirty (30) inches.

In some embodiments (not shown) not comprising length adjuster 106, first coupling device 107 and second coupling device 109 are fixedly positioned along first length 122. In some embodiments not comprising first length 122 and not comprising length adjuster 106, flexible member 102 is formed in a closed loop.

Figure 5:
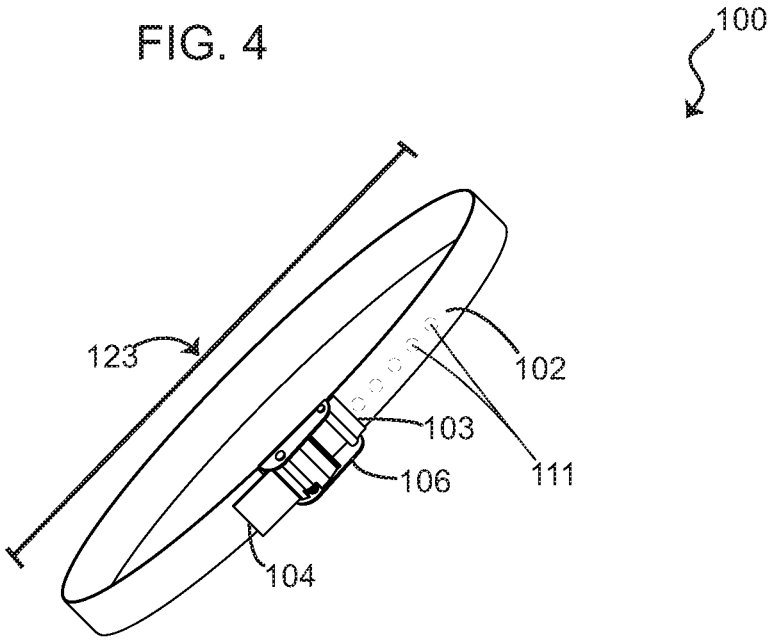
FIG. 5 is a perspective view of a flexible member retained into a closed loop by a length adjuster.

FIG. 5 is a perspective view of a flexible member retained into a closed loop by a length adjusting device. FIG. 5 shows second end 104 removeably and adjustably coupled to length adjustor 106 to form a closed-loop structure having a second length 123. Second length 123 is the length between first coupling device 107 and second coupling device 109 under a condition wherein flexible member 102 is under maximum tension in response to forces generated by the user during an exercise motion and opposed by first resistance body 131 and second resistance body 132. It will be appreciated from the several drawing figures that the point during the exercise motion wherein forces experienced by the user transition from those opposed by first resistance body 131 to a force of greater magnitude opposed by the combination of first resistance body 131 and second resistance body 132 are determined by second length 123, the design of resistance machine 130, along with the dimensional characteristics of resistive elements 133. A maximum value for second length 123 is determined by first length 122.

In some embodiments not comprising length adjustor 106 wherein flexible member 102 is formed in a closed loop, first coupling device 107, second coupling device 109, or both first coupling device 107 and second coupling device 109 are fixedly positioned along flexible member 102. In some embodiments not comprising length adjustor 106 wherein flexible member 102 is formed in a closed loop, first coupling device 107, second coupling device 109, or both first coupling device 107 and second coupling device 109 are freely moveable along flexible member 102.

In the embodiments shown, and in some other embodiments, second length 123 is adjustable by moving flexible member 102 through length adjustor 106 in either direction, according to whether a shorter or a longer second length 123 is desired. Length adjustor 106 is configured to be continuously adjustable in the embodiment shown in FIG. 5, and in some other embodiments.

In some other embodiments, length adjustor 106 is configured to be incrementally adjustable, such as using holes 111 shown in broken lines in FIG. 5. For example, flexible member 102 may comprise a series of holes, protrusions, or other surface features linearly spaced at intervals that reversibly engage with length adjustor 106 only at one of the features, but not in between two features.

Flexible member 102, in some embodiments, is an elongate body that lacks rigidity, such as a strap, a cord, or similar freely flexible structure. For example, flexible member 102 may be a length of nylon webbing. First end 103 is an end of flexible member 102 which, in some embodiments, is configured for coupling to length adjustor 106. Using the non-limiting example wherein flexible member 102 is formed from a length of nylon webbing, first end 103 may be an end-segment of flexible member 102 passed around a feature of length adjuster 106 and then doubled back upon itself to form a loop which is secured with stitching. By contrast, second end 104 comprises the other end of flexible member 102 opposite first end 103. Second end 104, in some embodiments, if adjustably and removeably coupled to length adjuster 106 wherein, when coupled, flexible member 102 forms a reversibly closed loop, as shown in FIG. 5.

FIGS. 6*a-d* are side-views of a staged resistance training device coupled to a weight bodies of a weight machine. FIGS. 6*a-d* show the positions of staged resistance training device 100 coupled to resistive elements 133 of weight machine at an initial position 119, at a transition point 118 between a first stage 116 and a second stage 117 of a range of motion 115, and at the second stage 117.

Figure 6A:
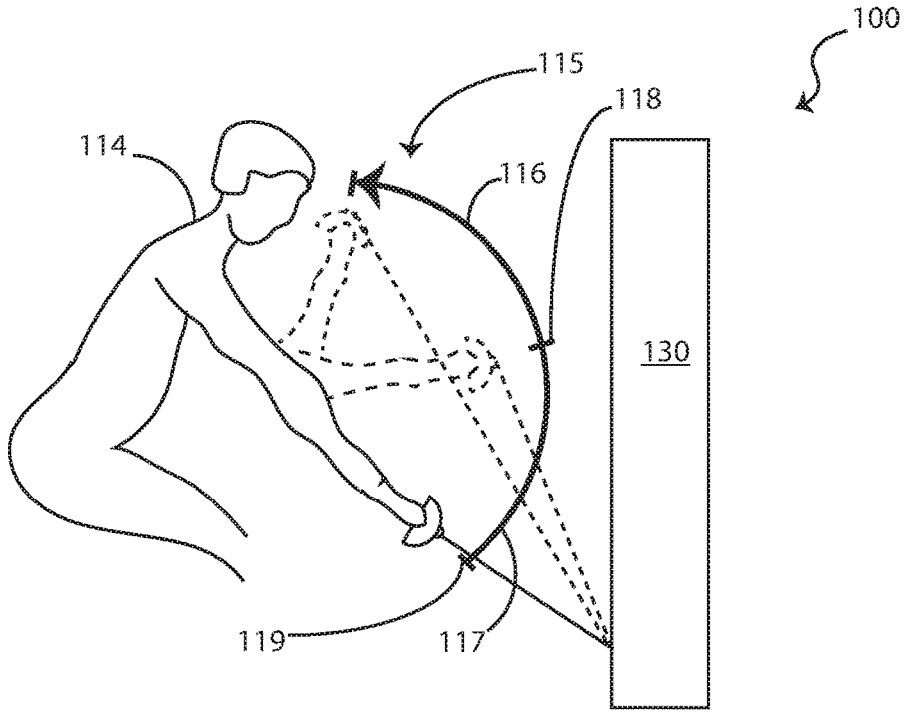
FIG. 6*a-d* are side-views of a staged resistance training device coupled to a weight bodies of a weight machine.
Figure 6B:
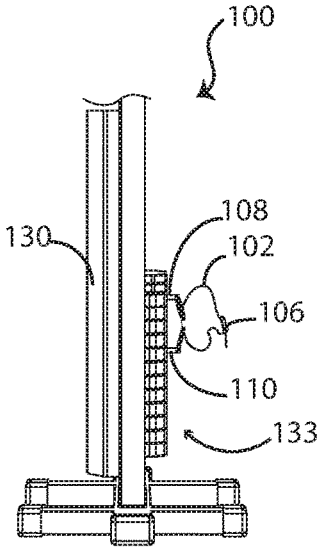

As shown in FIG. 6*a*, a user 114 is positioned for an exercise utilizing a weight machine 130. A body part of user 114 to be exercised, such as an arm, passes through a range of motion 115 during the exercise. Range of motion 115 represents the first half of an exercise rep wherein user 114 exerts a force causing motion of resistive elements 133. In the non-limiting example shown in FIGS. 6*b-d* wherein resistive elements 133 comprise a stack of weights, the force lifts weights from the weight stack against gravity. A second half of the exercise rep comprises lowering the lifted weights back onto the weight stack.

Range of motion 115 comprises, in order, initial position 119, first stage 116, transition point 118, and second stage 117. The solid line depiction of user 116's arm in FIG. 6*a* corresponds with the positions of first resistance body 131 and second resistance body 132 shown in FIG. 6*b*. The dashed line depictions of user 116's arm in FIG. 6*a* correspond with the positions of first resistance body 131 and second resistance body 132 shown in FIG. 6*b* and FIG. 6*c*. FIG. 6*a* shows first resistance body 131 and second resistance body 132 resting on the remainder of resistive elements 133. Staged resistance training device 100 is coupled to resistive elements 133 of weight machine 130 at first retainer 108 and second retainer 110. The positions wherein first retainer 108 and second retainer 110 are coupled to resistive elements 133 determine the degree of resistive force during first stage 116 and second stage 117, and are selected by a user of staged resistance training device 100. The user, therefore, determines the configuration of resistive elements 133 and staged resistive training device 100 at initial position 119 shown by FIG. 6*a*. At initial position 119, flexible body 102 is slack and under no tension, and neither first resistance body 131 nor second resistance body 132 are separated from the remainder of resistive elements 133. In other words, at initial position 119 of range of range of motion 115, no force has been applied by user 114 that is opposed by first resistance body 131 or second resistance body 132.

Figure 6C:
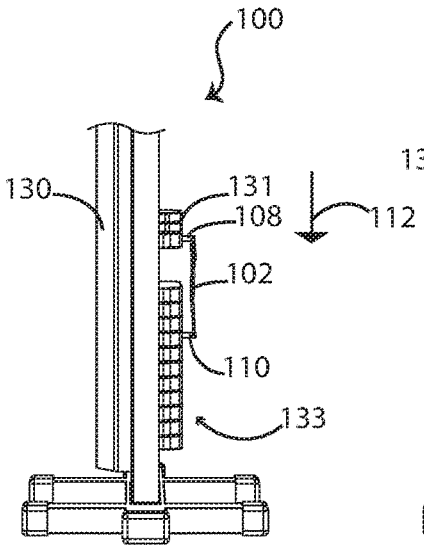
Figure 6D:
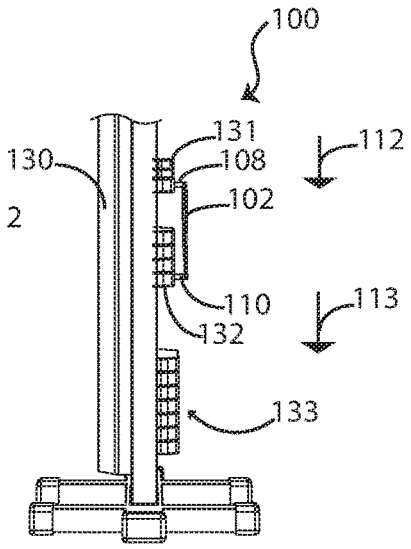

As user 114 begins the rep, range of motion 115 proceeds through first stage 116, as shown by FIG. 6*a*, to transition point 118. The configuration of device 100, first resistance body 131 and second resistance body 132 at the moment range of motion 115 reaches transition point 118 is shown by FIG. 6*c*. At transition point 118 separating first stage 116 and second stage 117, flexible body 102 is taut and second resistance body 132 is not yet opposing range of motion 115. Throughout first stage 116, flexible body 102 is at least partially slack, first resistive body is opposing the exercise force from user 116, and second resistance body 132 is not opposing the exercise force from user 116. Throughout second stage 117, flexible body 102 is taut and the combined first resistance body 131 and second resistance body 132 is opposing the exercise force from user 116. During the first half of an exercise repetition, shown by FIG. 6*a*, user 116 experiences a first resistance caused by first resistance body 131 during first stage 116 followed by a second resistance, which is greater in magnitude than the first resistance, created by the combined resistance of first resistance body 131 and second resistance body 132. Staged resistance training device 100, therefore, enables a user to set greater than one level of resistance during each single exercise repetition.

The components defining any staged resistance training device may be formed of any of many different types of materials or combinations thereof that can readily be formed into shaped objects provided that the components selected are consistent with the intended operation of the staged resistance training device. For example, the components may be formed of: rubbers (synthetic and/or natural) and/or other like materials; carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any staged-resistance training device may be purchased pre-manufactured or manufactured separately and then assembled together. However, any of or all the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, annealing, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

Figure 7:
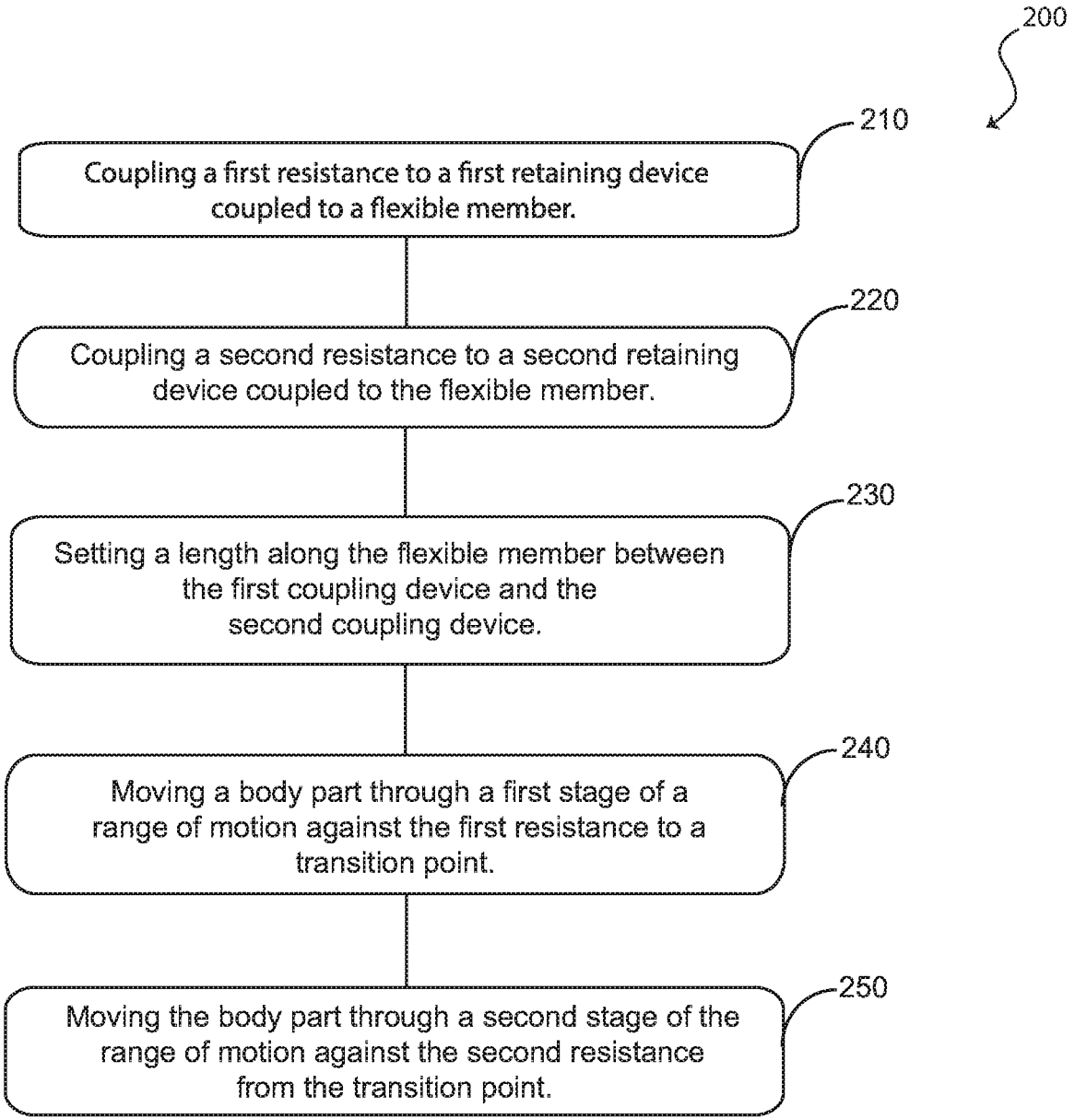
FIG. 7 is a flowchart diagram of a method of using a staged resistance training device.

FIG. 7 is a flowchart diagram of a method of using a staged resistance training device. FIG. 7 shows a method 200 having a first coupling step 210, a second coupling step 220, a setting step 230, a first moving step 240, and a second moving step 250.

Step 210 of method 200 comprises coupling a first resistance to a first retaining device on a flexible member. In some embodiments, step 210 comprises inserting the first retaining device in between resistance bodies comprised by a stack of resistive elements. In some embodiments, step 210 comprises selecting a resistance on a hydraulic cylinder. In some embodiments, step 210 comprises selecting a resistance spring, wherein the resistive elements comprise a plurality of resistance springs. In some embodiments.

Step 220 of method 200 comprises coupling a second resistance to a second retaining device on the flexible member. The second resistance, in some embodiments, comprises the first resistance coupled with an additional resistance.

Step 230 of method 200 comprises setting a length along the flexible member between the first retaining device and the second retaining device. Setting step 230, in some embodiments, comprises setting a second length of the flexible member using a length adjuster coupled to the flexible member in order to cause division of a range of motion experienced by a body part performing an exercise using the staged resistance training device into a first stage opposed by the first resistance sequentially followed by a second stage opposed by the second resistance.

Step 240 of method 200 comprises moving a body part through a first stage of a range of motion against the first resistance to a transition point. The transition point is the point during the range of motion wherein the user of the staged resistance training device completes the first stage.

Step 250 of method 200 comprises moving the body part through a second stage of the range of motion against the second resistance from the transition point. The second stage is the point during the range of motion beginning at the transition point.

The embodiments and examples set forth herein were presented to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings herein without departing from the spirit and scope of the forthcoming claims.

What is claimed is:

1. A staged-resistance training device comprising:

a flexible member having a first end, a second end, and a first length;

a length adjuster coupled to the first end and adjustably coupled to the second end to form a closed loop having a second length;

a first retainer slidably coupled to the flexible member via a first coupling member; and a second retainer slidably coupled to the flexible member via a second coupling member;

wherein movement of the flexible member through the length adjuster changes the second length along the flexible member between the first retainer and the second retainer.

2. The staged-resistance training device of claim 1, wherein the first retainer is operatively coupled to the flexible member by a first coupling device.

3. The staged-resistance training device of claim 1, wherein the second retainer is operatively coupled to the flexible member by a second coupling device.

4. The staged-resistance training device of claim 1, wherein the length adjuster is adjustable along a continuum.

5. The staged-resistance training device of claim 1, wherein the length adjuster is adjustable in increments.

6. The staged-resistance training device of claim 1, comprising a plurality of flexible members having a plurality of first lengths, each of the plurality of flexible members interchangeable with the length adjuster, the first retainer, and the second retainer.

* * * * *